US011821127B2

(12) United States Patent
Cheon et al.

(10) Patent No.: US 11,821,127 B2
(45) Date of Patent: Nov. 21, 2023

(54) LAUNDRY TREATMENT MACHINE

(71) Applicant: LG ELECTRONICS INC., Seoul (KR)

(72) Inventors: Changyoung Cheon, Seoul (KR); Jihoon Kim, Seoul (KR); Junho Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 370 days.

(21) Appl. No.: 17/258,043

(22) PCT Filed: Jul. 5, 2019

(86) PCT No.: PCT/KR2019/008287
§ 371 (c)(1),
(2) Date: Jan. 5, 2021

(87) PCT Pub. No.: WO2020/009530
PCT Pub. Date: Jan. 9, 2020

(65) Prior Publication Data

US 2021/0285143 A1 Sep. 16, 2021

(30) Foreign Application Priority Data

Jul. 6, 2018 (KR) ..... 10-2018-0079042

(51) Int. Cl.
*D06F 34/10* (2020.01)
*D06F 37/30* (2020.01)
*D06F 39/08* (2006.01)

(52) U.S. Cl.
CPC ..... *D06F 34/10* (2020.02); *D06F 37/30* (2013.01); *D06F 37/304* (2013.01);
(Continued)

(58) Field of Classification Search
CPC ..... D06F 34/10
See application file for complete search history.

(56) References Cited

U.S. PATENT DOCUMENTS

2016/0053422 A1 2/2016 Im et al.
2016/0344324 A1* 11/2016 Jang ..... D06F 37/304
2017/0247826 A1 8/2017 Takashima et al.

FOREIGN PATENT DOCUMENTS

EP 2 781 640 9/2014
JP 09-140984 6/1997
(Continued)

OTHER PUBLICATIONS

International Search Report (with English Translation) dated Nov. 6, 2019 issued in Application No. PCT/KR2019/008287.
(Continued)

*Primary Examiner* — Jason Y Ko
(74) *Attorney, Agent, or Firm* — KED & Associates LLP

(57) ABSTRACT

The present disclosure relates to a laundry treatment machine. A laundry treatment machine according to an embodiment of the present disclosure includes: an inverter converting a direct current (DC) voltage from a converter into an alternating current (AC) voltage based on a switching operation and outputting the converted AC voltage to a circulation pump motor; and a controller to control a speed of the circulation pump motor to be increased before a time point at which a speed of a washing tub motor increases. Accordingly, the washing tub motor and the circulation pump motor can be operated in synchronization with each other. As a result, it is possible to improve washing power based on circulation pumping during washing.

19 Claims, 19 Drawing Sheets

(52) U.S. Cl.
CPC ..... *D06F 37/308* (2013.01); *D06F 39/08* (2013.01); *D06F 39/085* (2013.01)

(56) References Cited

FOREIGN PATENT DOCUMENTS

| | | |
|---|---|---|
| JP | 2001-276485 | 10/2001 |
| JP | 2002-166090 | 6/2002 |
| JP | 2012-040083 | 3/2012 |
| KR | 10-2016-00449 01 | 4/2016 |
| KR | 10-2017-01004 06 | 9/2017 |

OTHER PUBLICATIONS

Written Opinion dated Nov. 6, 2019 issued in Application No. PCT/KR2019/008287.

* cited by examiner

LAUNDRY TREATMENT MACHINE

CROSS-REFERENCE TO RELATED PATENT APPLICATIONS

This application is a U.S. National Stage Application under 35 U.S.C. § 371 of PCT Application No. PCT/KR2019/008287, filed Jul. 5, 2019, which claims priority to Korean Patent Application No. 10-2018-0079042, filed Jul. 6, 2018, whose entire disclosures are hereby incorporated by reference.

BACKGROUND OF THE DISCLOSURE

1. Field of the Disclosure

The present disclosure relates to a laundry treatment machine, and more particularly, to a laundry treatment machine capable of operating a washing tub motor and a circulation pump motor in synchronization with each other.

Further, the present disclosure relates to a laundry treatment machine capable of improving washing power based on circulation pumping during washing.

Further, the present disclosure relates to a laundry treatment machine capable of driving a circulation pump motor in a sensorless manner.

Further, the present disclosure relates to a laundry treatment machine capable of improving the stability of a converter.

2. Description of the Related Art

A circulation pump driving apparatus drives a circulation pump motor to pump water entering a water introduction part to be drained into a washing tub.

When using an alternating current (AC) pump motor in order to drive a circulation pump, the motor is normally driven by a constant speed operation with an input AC voltage.

For example, when the frequency of the input AC voltage is 50 Hz, the circulation pump motor rotates at 3,000 rpm, and, when the frequency of the input AC voltage is 60 Hz, the circulation pump motor rotates at 3,600 rpm.

Such an AC pump motor has a drawback such as an extended period of time for completion of drainage because the speed of the motor is not controlled during drainage.

In order to address the drawback, researches are being conducted to apply a direct current (DC) brushless motor as a circulation pump motor.

Examples of a drain pump motor based on a DC brushless motor are disclosed in Japanese Patent Application Laid-Open Nos. 2001-276485 and 2002-166090.

In the prior documents, there is a drawback such as an extended period of time for completion of drainage during drainage because speed control is performed when the drain pump motor is controlled.

In addition, these prior documents disclose the control of the drain pump motor rather than the control of the circulation pump motor, and merely disclose that the speed control is performed at the time of controlling the drain pump motor, without disclosing unnecessary power consumption resulting from non-synchronization of the circulation pump motor with a washing tub motor.

SUMMARY

The present disclosure provides a laundry treatment machine capable of operating a washing tub motor and a circulation pump motor in synchronization with each other.

Further, the present disclosure provides a laundry treatment machine capable of improving washing power based on circulation pumping during washing.

Further, the present disclosure provides a laundry treatment machine capable of driving a circulation pump motor in a sensorless manner.

An embodiment of the present disclosure provides a laundry treatment machine including: an inverter converting a direct current (DC) voltage from a converter into an alternating current (AC) voltage based on a switching operation and outputting the converted AC voltage to a circulation pump motor; and a controller to control a speed of the circulation pump motor to be increased before a time point at which a speed of a washing tub motor increases.

In the laundry treatment machine according to an embodiment of the present disclosure, the controller may control the speed of the circulation pump motor to be decreased at a time point when the speed of the washing tub motor decreases.

In the laundry treatment machine according to an embodiment of the present disclosure, the controller may control the speed of the washing tub motor to be constant between a speed increase period and a speed decrease period of the circulation pump motor.

In the laundry treatment machine according to an embodiment of the present disclosure, the controller may control the speed of the washing tub motor to be increased step by step between a speed increase period and a speed decrease period of the circulation pump motor.

In the laundry treatment machine according to an embodiment of the present disclosure, the controller may control the circulation pump motor such that wash water circulated by pumping of a circulation pump is sprayed into a washing tub through spraying ports formed in the washing tub in synchronization with an operation timing of the washing tub motor.

Another embodiment of the present disclosure provides a laundry treatment machine including: an inverter converting a direct current (DC) voltage from a converter into an alternating current (AC) voltage based on a switching operation and outputting the converted AC voltage to a circulation pump motor; and a controller to control a speed increase period of the circulation pump motor to be synchronized in response to a speed increase period of a washing tub motor.

Advantageous Effects

According to an embodiment of the present disclosure, there is provided a laundry treatment machine including: an inverter converting a direct current (DC) voltage from a converter into an alternating current (AC) voltage based on a switching operation and outputting the converted AC voltage to a circulation pump motor; an output current detector detecting an output current flowing in the circulation pump motor; and a controller to control a speed of the circulation pump motor to be increased before a time point at which a speed of a washing tub motor increases. Accordingly, the washing tub motor and the circulation pump motor can be operated in synchronization with each other. As a result, it is possible to improve washing power based on circulation pumping during washing.

In the laundry treatment machine according to an embodiment of the present disclosure, the controller may control the speed of the circulation pump motor to be decreased at a time point when the speed of the washing tub motor decreases. Accordingly, the washing tub motor and the circulation pump motor can be turned to an operation-off state in synchronization with each other. As a result, it is possible to reduce unnecessary power consumption of the circulation pump motor.

In the laundry treatment machine according to an embodiment of the present disclosure, the controller may control the speed of the washing tub motor to be constant between a speed increase period and a speed decrease period of the circulation pump motor. Accordingly, it is possible to improve washing power based on circulation pumping during washing.

In the laundry treatment machine according to an embodiment of the present disclosure, the controller may control the speed of the washing tub motor to be increased step by step between a speed increase period and a speed decrease period of the circulation pump motor. Accordingly, it is possible to improve washing power based on circulation pumping during washing.

In the laundry treatment machine according to an embodiment of the present disclosure, the controller may control the circulation pump motor such that wash water circulated by pumping of a circulation pump is sprayed into a washing tub through spraying ports formed in the washing tub in synchronization with an operation timing of the washing tub motor. Accordingly, it is possible to improve washing power based on circulation pumping during washing.

Power control may be performed on the circulation pump motor to be driven with a constant power, and thereby, the converter merely needs to supply the constant power. Thus, the stability of the converter can be improved.

According to another embodiment of the present disclosure, there is provided a laundry treatment machine including: an inverter converting a direct current (DC) voltage from a converter into an alternating current (AC) voltage based on a switching operation and outputting the converted AC voltage to a circulation pump motor; and a controller to control a speed increase period of the circulation pump motor to be synchronized in response to a speed increase period of a washing tub motor. Accordingly, the washing tub motor and the circulation pump motor can be operated in synchronization with each other. As a result, it is possible to improve washing power based on circulation pumping during washing.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION OF THE PREFERRED EMBODIMENTS

Reference will now be made in detail to the preferred embodiments of the present disclosure, examples of which are illustrated in the accompanying drawings. Wherever possible, the same reference numbers will be used throughout the drawings to refer to the same or like parts.

As used herein, the suffixes "module" and "unit" are added or used interchangeably to facilitate preparation of this specification and are not intended to suggest distinct meanings or functions. Accordingly, the terms "module" and "unit" may be used interchangeably.

Figure 1:
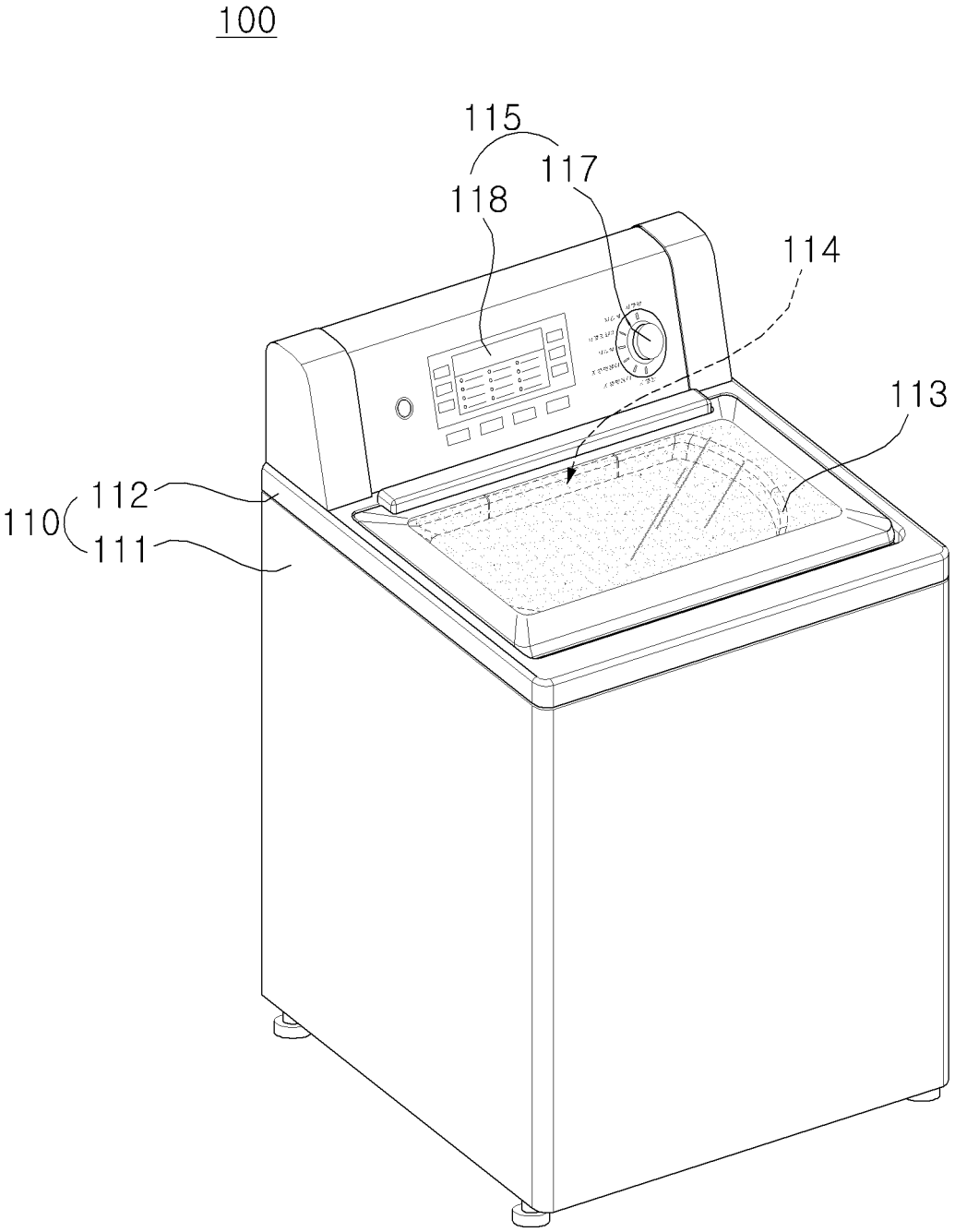
FIG. 1 is a perspective view illustrating a laundry treatment machine according to an embodiment of the present disclosure.
Figure 2:
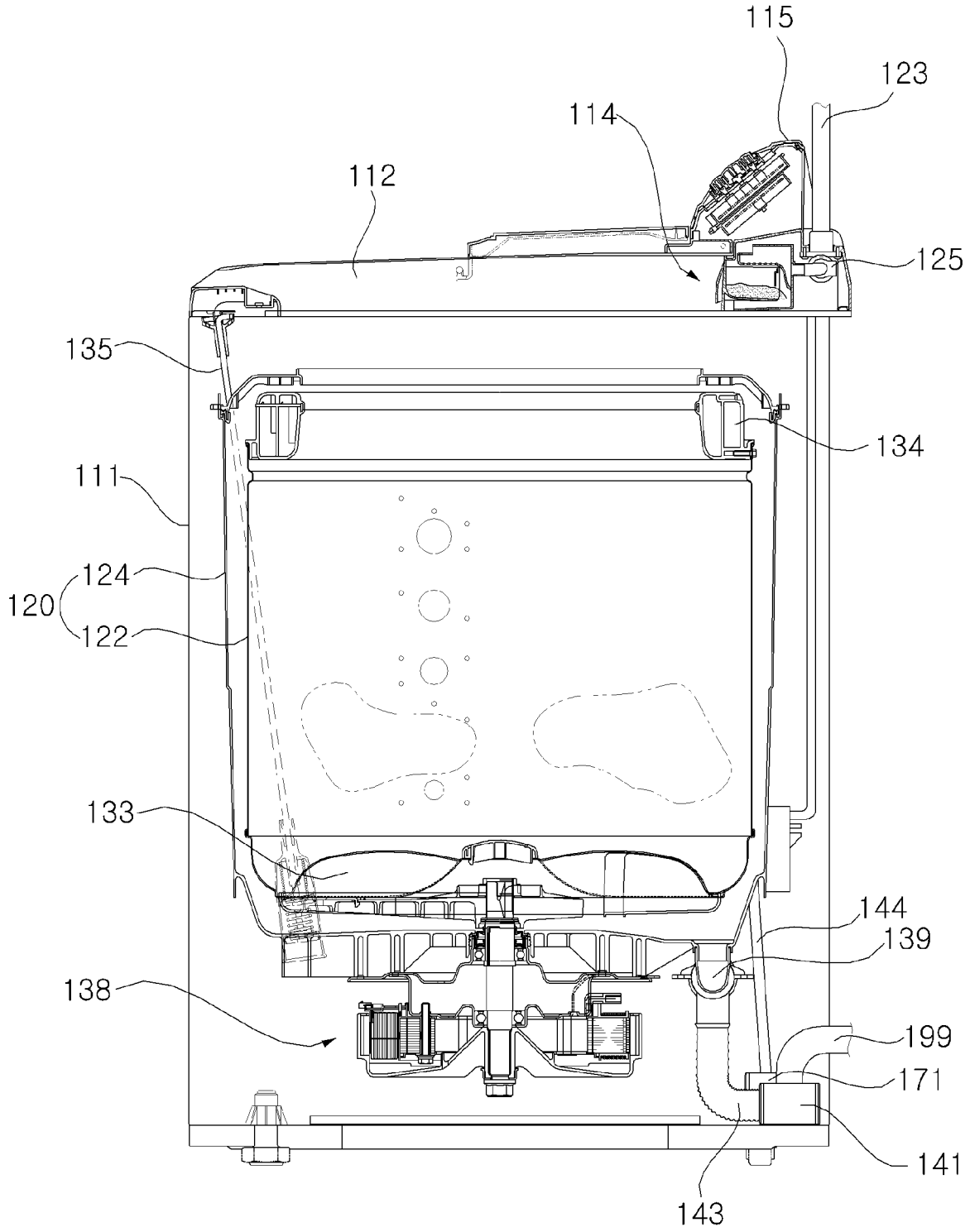
FIG. 2 is a side cross-sectional view of the laundry treatment machine of FIG. 1.

FIG. 1 is a perspective view illustrating a laundry treatment machine according to an embodiment of the present disclosure, and FIG. 2 is a side cross-sectional view illustrating the laundry treatment machine of FIG. 1.

Referring to FIGS. 1 and 2, the laundry treatment machine 100 according to an embodiment of the present disclosure conceptually includes a washing machine having fabric inserted therein for performing washing, rinsing and dewatering, or a dryer having wet fabric inserted therein. The washing machine will be mainly described below.

The washing machine 100 includes a casing 110 forming an outer appearance, operation keys for receiving various control commands from a user, and a control panel 115 equipped with a display for displaying information on the operating state of the washing machine 100 to provide a user interface, and a door 113 rotatably installed in the casing 110 to open and close an entrance hole through which the laundry enters and exits.

The casing 110 includes a body 111 for defining a space in which various components of the washing machine 100 can be accommodated and a top cover 112 provided at an upper side of the body 111 and forming a fabric entrance hole to allow the laundry to be introduced into an inner tub 122 therethrough.

The casing 110 is described as including the body 111 and the top cover 112, but the casing 110 is not limited thereto as long as it forms the appearance of the washing machine 100.

A support rod 135 is coupled to the top cover 112 which is one of the constituent elements of the casing 110. However, the support rod 135 is not limited thereto and may be coupled to any part of the fixed portion of the casing 110.

The control panel 115 includes operation keys 117 for controlling an operation state of the laundry treatment machine 100 and a display 118 disposed on one side of the operation keys 117 to display the operation state of the laundry treatment machine 100.

The door 113 opens and closes a fabric entrance hole (not shown) formed in the top cover 112 and may include a transparent member such as reinforced glass to allow the inside of the body 111 to be seen.

The washing machine 100 may include a washing tub 120. The washing tub 120 may include an outer tub 124 containing wash water and an inner tub 122 rotatably installed in the outer tub 124 to accommodate laundry. A balancer 134 may be provided at the upper portion of the washing tub 120 to compensate for unbalance amount generated when the washing tub 120 rotates.

Meanwhile, the washing machine 100 may include a pulsator 133 rotatably provided at a lower portion of the washing tub 120.

The driving apparatus 138 serves to provide a driving force for rotating the inner tub 122 and/or the pulsator 133. A clutch (not shown) for selectively transmitting the driving force of the driving apparatus 138 may be provided such that only the inner tub 122 is rotated, only the pulsator 133 is rotated, or the inner tub 122 and the pulsator 133 are rotated at the same time.

Figure 3:
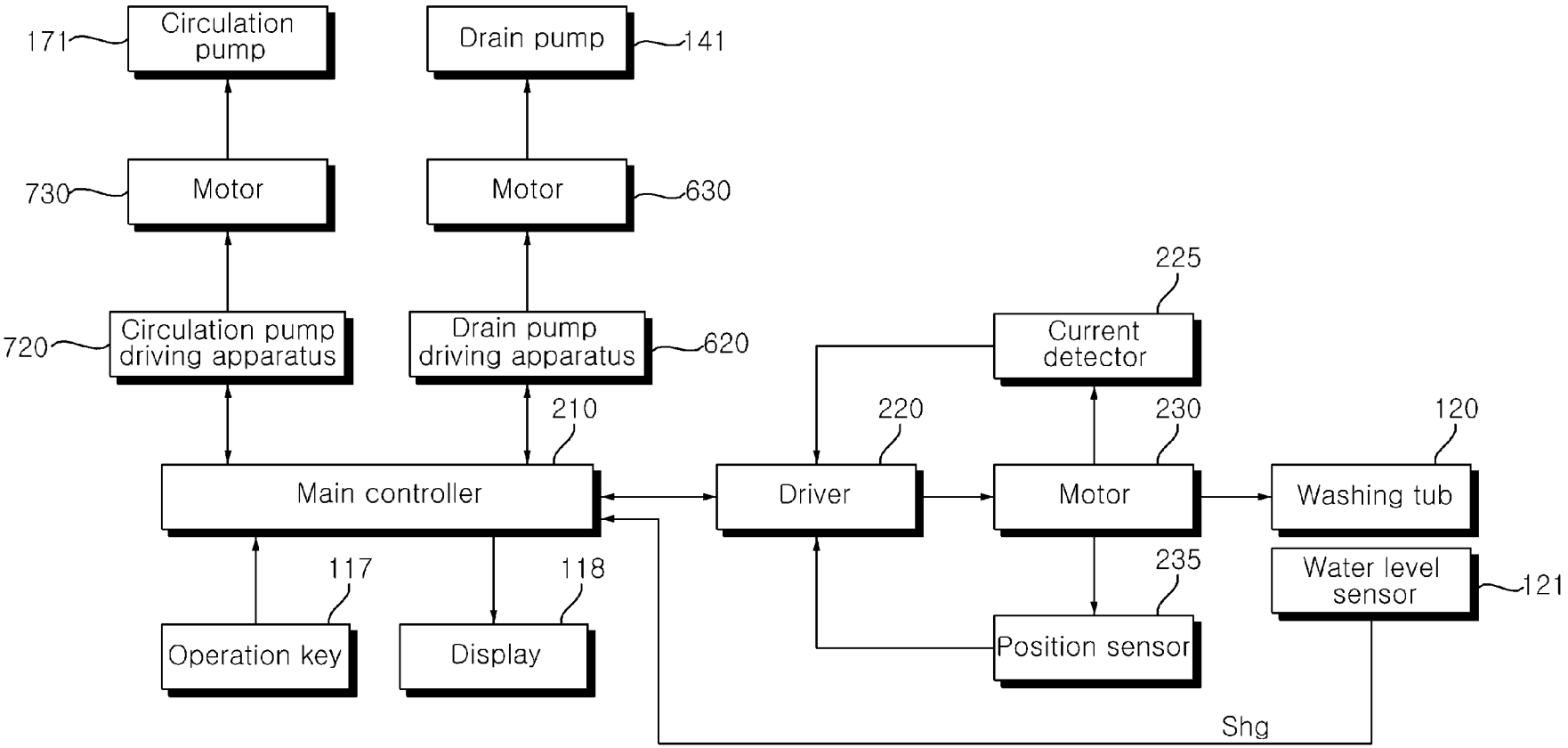
FIG. 3 is an internal block diagram of the laundry treatment machine of FIG. 1.

The driving apparatus 138 is operated by a driver 220 of FIG. 3, that is, a driving circuit. This will be described later with reference to FIG. 3 and other drawings.

A detergent box 114 for accommodating various additives such as a laundry detergent, a fabric softener, and/or a bleaching agent is retrievably provided to the top cover 112, and the wash water supplied through a water supply channel 123 flows into the inner tub 122 via the detergent box 114.

A plurality of holes (not shown) is formed in the inner tub 122. Thereby, the wash water supplied to the inner tub 122 flows to the outer tub 124 through the plurality of holes. A water supply valve 125 for regulating the water supply channel 123 may be provided.

The wash water is drained from the outer tub 124 through a drain channel 143. A drain valve 145 for regulating the drain channel 143 and a drain pump 141 for pumping the wash water may be provided.

Moreover, a circulation pump 171 for pumping wash water may be provided on an end of the drain channel 143. The wash water pumped by the circulation pump 171 may be introduced into a washing tub 120 through a circulation channel 144.

The support rod 135 is provided to hang the outer tub 124 in the casing 110. One end of the support rod 135 is connected to the casing 110 and the other end of the support rod 135 is connected to the outer tub 124 by a suspension 150.

The suspension 150 attenuates vibration of the outer tub 124 during the operation of the washing machine 100. For example, the outer tub 124 may be vibrated by vibration generated as the inner tub 122 rotates. While the inner tub 122 rotates, the vibration caused by various factors such as unbalance laundry amount of laundry in the inner tub 122, the rotational speed of the inner tub 122 or the resonance characteristics of the inner tub 122 can be attenuated.

FIG. 3 is an internal block diagram of the laundry treatment machine of FIG. 1.

Referring to FIG. 3, in the laundry treatment machine 100, the driver 220 is controlled by the main controller 210, and the driver 220 drives the motor 230. Thereby, the washing tub 120 is rotated by the motor 230.

Meanwhile, the laundry treatment machine 100 may include a motor 630 for driving the drain pump 141 and a drain pump driving apparatus 620 for driving the motor 630. The drain pump driving apparatus 620 may be controlled by the main controller 210.

Meanwhile, the laundry treatment machine 100 may include a circulation pump motor 730 for driving the circulation pump 171 and a circulation pump driving apparatus 720 for driving the circulation pump motor 730. The circulation pump driving apparatus 720 may be controlled by the main controller 210.

In this specification, the circulation pump driving apparatus 720 may be referred to as a circulation pump driver.

The main controller 210 operates by receiving an operation signal from an operation key 117. Accordingly, washing, rinsing, and dewatering processes may be performed.

In addition, the main controller 210 may control the display 118 to display a washing course, a washing time, a dewatering time, a rinsing time, a current operation state, or the like.

Meanwhile, the main controller 210 controls the driver 220 to operate the motor 230. For example, the main controller 210 may control the driver 220 to rotate the motor 230, based on a current detector 225 for detecting an output current flowing in the motor 230 and a position sensor 235 for sensing a position of the motor 230. While it is illustrated in FIG. 3 that the detected current and the sensed position signal are input to the driver 220, embodiments of the present disclosure are not limited thereto. The detected current and the sensed position signal may be input to the main controller 210 or to both the main controller 210 and the driver 220.

The driver 220, which serves to drive the motor 230, may include an inverter (not shown) and an inverter controller (not shown). In addition, the driver 220 may further include a converter or the like for supplying a direct current (DC) voltage input to the inverter (not shown).

For example, when the inverter controller (not shown) outputs a switching control signal in a pulse width modulation (PWM) scheme to the inverter (not shown), the inverter (not shown) may perform a high-speed switching operation to supply an alternating current (AC) voltage at a predetermined frequency to the motor 230.

The main controller 210 may sense a laundry amount based on a current io detected by the current detector 225 or a position signal H sensed by the position sensor 235. For example, while the washing tub 120 rotates, the laundry amount may be sensed based on the current value io of the motor 230.

The main controller 210 may sense an amount of eccentricity of the washing tub 120, that is, an unbalance (UB) of the washing tub 120. The sensing of the amount of eccentricity may be performed based on a ripple component of the current io detected by the current detector 225 or an amount of change in rotational speed of the washing tub 120.

Meanwhile, a water level sensor 121 may measure a water level in the washing tub 120.

For example, a water level frequency at a zero water level with no water in the washing tub 120 may be 28 KHz, and a frequency at a full water level at which water reaches an allowable water level in the washing tub 120 may be 23 KHz.

That is, the frequency of the water level detected by the water level sensor 121 may be inversely proportional to the water level in the washing tub.

The water level Shg in the washing tub output from the water level sensor 121 may be a water level frequency or a water level that is inversely proportional to the water level frequency.

Meanwhile, the main controller 210 may determine whether the washing tub 120 is at a full water level, a zero water level, or a reset water level, based on the water level Shg in the washing tub detected by the water level sensor 121.

Figure 4:
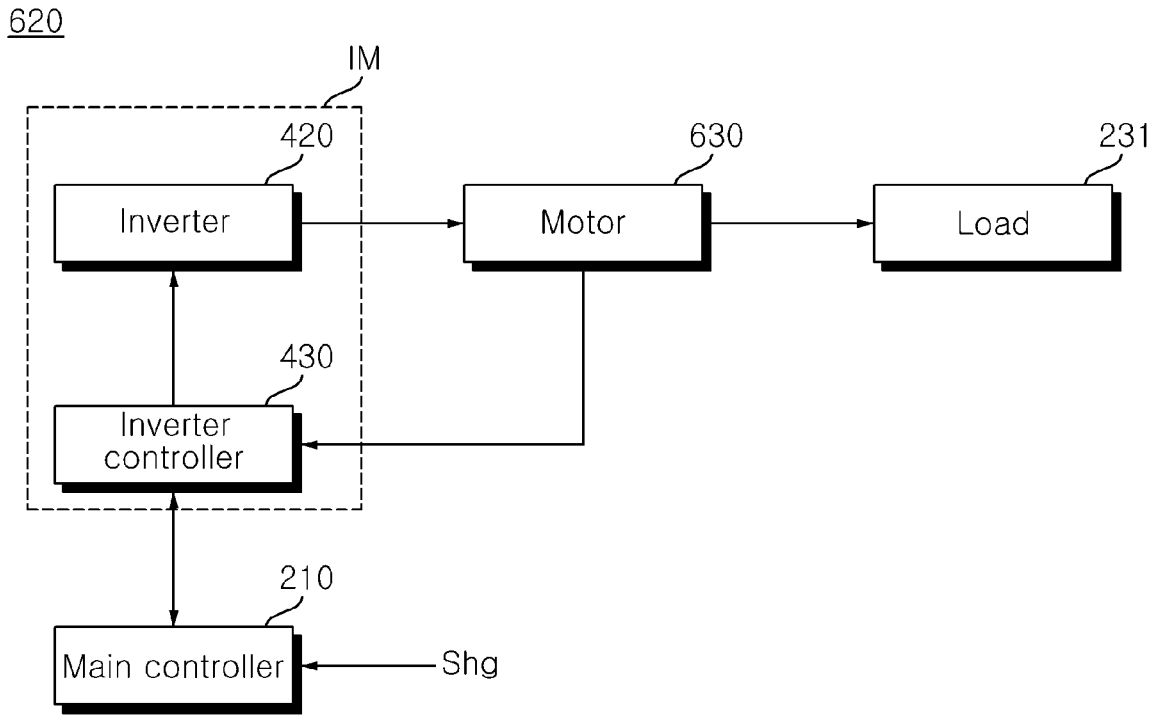
FIG. 4 illustrates an example of an internal block diagram of a circulation pump driving apparatus of FIG. 1.
Figure 5:
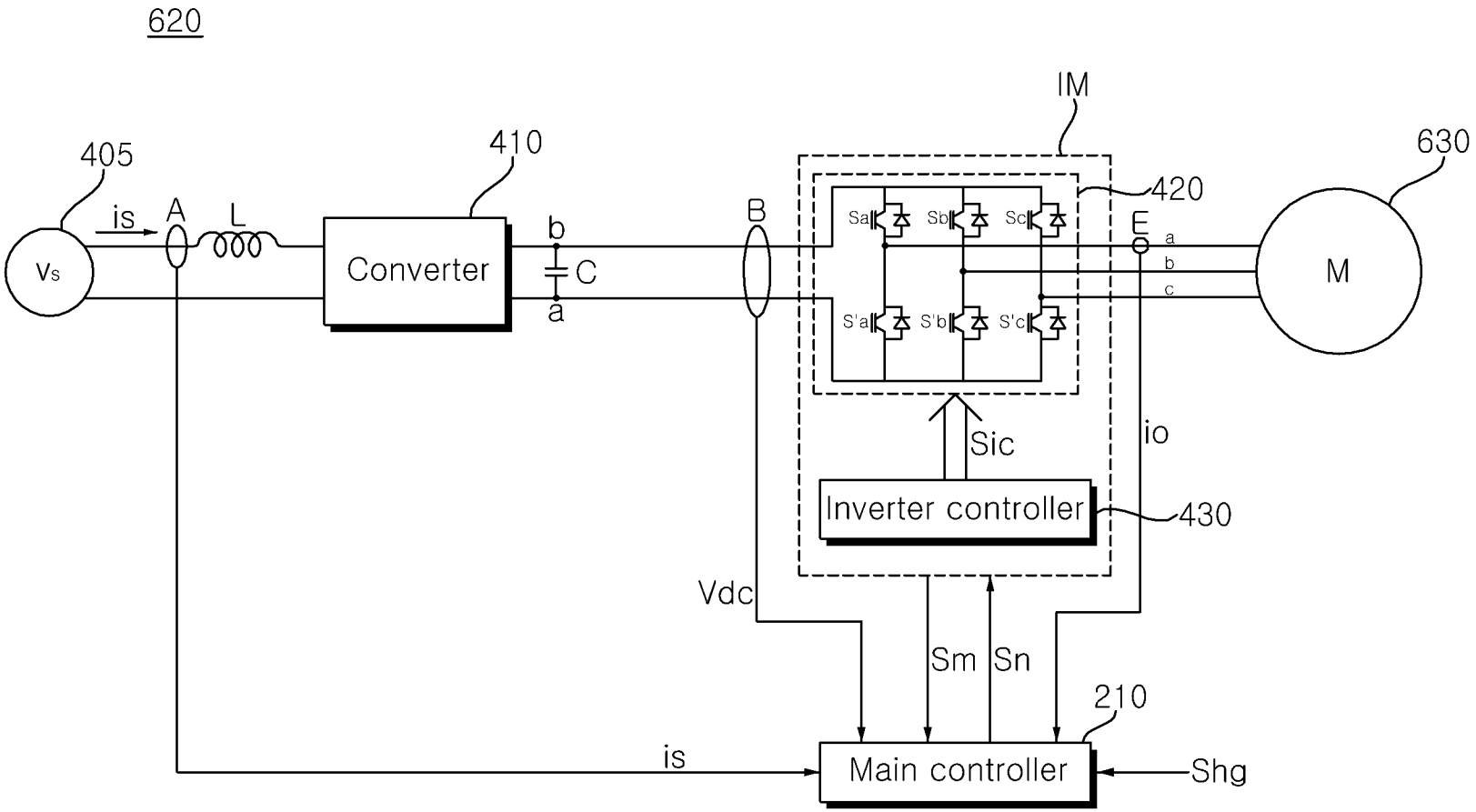
FIG. 5 illustrates an example of an internal circuit diagram of the circulation pump driving apparatus of FIG. 4.

FIG. 4 illustrates an example of an internal block diagram of the circulation pump driving apparatus of FIG. 1, and FIG. 5 illustrates an example of an internal circuit diagram of the circulation pump driving apparatus of FIG. 4.

Referring to FIGS. 4 and 5, the circulation pump driving apparatus 720 according to an embodiment of the present disclosure serves to drive the circulation pump motor 730 in a sensorless manner, and may include an inverter 420, an inverter controller 430, and a main controller 210.

The main controller 210 and the inverter controller 430 may correspond to a controller and a second controller described in this specification, respectively.

The circulation pump driving apparatus 720 according to an embodiment of the present disclosure may include a converter 410, a DC terminal voltage detector B, a DC terminal capacitor C, and an output current detector E. In addition, the circulation pump driving apparatus 720 may further include an input current detector A and a reactor L.

Hereinafter, an operation of each constituent unit in the circulation pump driving apparatus 720 of FIGS. 4 and 5 will be described.

The reactor L is disposed between a commercial AC voltage source 405 (vs) and the converter 410, and performs a power factor correction operation or a boost operation. In addition, the reactor L may also function to limit a harmonic current resulting from high-speed switching of the converter 410.

The input current detector A may detect an input current is is input from the commercial AC voltage source 405. To this end, a current transformer (CT), a shunt resistor, or the like may be used as the input current detector A. The detected input current is is may be input to the inverter controller 430 or the main controller 210 as a discrete signal in the form of a pulse. In FIG. 5, it is illustrated that the detected input current is is input to the main controller 210.

The converter 410 converts the commercial AC voltage source 405 having passed through the reactor L into a DC voltage and outputs the DC voltage. Although the commercial AC voltage source 405 is shown as a single-phase AC voltage source in FIG. 5, it may be a 3-phase AC voltage source. The converter 410 has an internal structure that varies depending on the type of commercial AC voltage source 405.

Meanwhile, the converter 410 may be configured with diodes or the like without a switching device, and may perform a rectification operation without a separate switching operation.

For example, in case of the single-phase AC voltage source, four diodes may be used in the form of a bridge. In case of the 3-phase AC voltage source, six diodes may be used in the form of a bridge.

As the converter 410, for example, a half-bridge type converter having two switching devices and four diodes connected to each other may be used. In case of the 3-phase AC voltage source, six switching devices and six diodes may be used for the converter.

When the converter 410 has a switching device, a boost operation, a power factor correction, and a DC voltage conversion may be performed by the switching operation of the switching device.

Meanwhile, the converter 410 may include a switched mode power supply (SMPS) having a switching device and a transformer.

The converter 410 may convert a level of an input DC voltage and output the converted DC voltage.

The DC terminal capacitor C smooths the input voltage and stores the smoothed voltage. In FIG. 5, one element is exemplified as the DC terminal capacitor C, but a plurality of elements may be provided to secure element stability.

While it is illustrated in FIG. 5 that the DC terminal capacitor C is connected to an output terminal of the converter 410, embodiments of the present disclosure are not limited thereto. The DC voltage may be input directly to the DC terminal capacitor C.

For example, a DC voltage from a solar cell may be input directly to the DC terminal capacitor C or may be DC-to-DC converted and input to the DC terminal capacitor C. Hereinafter, what is illustrated in FIG. 5 will be mainly described.

Both ends of the DC terminal capacitor C may be referred to as DC terminals or DC link terminals because the DC voltage is stored therein.

The DC terminal voltage detector B may detect a voltage Vdc between the DC terminals, which are both ends of the DC terminal capacitor C. To this end, the DC terminal voltage detector B may include a resistance element and an amplifier. The detected DC terminal voltage Vdc may be input to the inverter controller 430 or the main controller 210 as a discrete signal in the form of a pulse. In FIG. 5, it is illustrated that the detected DC terminal voltage Vdc is input to the main controller 210.

The inverter 420 may include a plurality of inverter switching devices. The inverter 420 may convert the smoothed DC voltage Vdc into an AC voltage by an on/off operation of the switching device, and output the AC voltage to the synchronous motor 630.

For example, when the synchronous motor 630 is in a 3-phase type, the inverter 420 may convert the DC voltage Vdc into 3-phase AC voltages va, vb and vc and output the 3-phase AC voltages to the three-phase synchronous motor 630 as shown in FIG. 5.

As another example, when the synchronous motor 630 is in a single-phase type, the inverter 420 may convert the DC voltage Vdc into a single-phase AC voltage and output the single-phase AC voltage to a single-phase synchronous motor 630.

The inverter 420 includes upper switching devices Sa, Sb and Sc and lower switching devices S'a, S'b and S'c. Each of the upper switching devices Sa, Sb and Sc that are connected to one another in series and a respective one of the lower switching devices S'a, S'b and S'c that are connected to one another in series form a pair. Three pairs of upper and lower switching devices Sa and S'a, Sb and S'b, and Sc and S'c are connected to each other in parallel. Each of the switching devices Sa, S'a, Sb, S'b, Sc and S'c is connected with a diode in anti-parallel.

Each of the switching devices in the inverter 420 is turned on/off based on an inverter switching control signal Sic from the inverter controller 430. Thereby, an AC voltage having a predetermined frequency is output to the synchronous motor 630.

The inverter controller 430 may output the switching control signal Sic to the inverter 420.

In particular, the inverter controller 430 may output the switching control signal Sic to the inverter 420, based on a voltage command value Sn input from the main controller 210.

The inverter controller 430 may output voltage information Sm of the circulation pump motor 730 to the main controller 210, based on the voltage command value Sn or the switching control signal Sic.

The inverter 420 and the inverter controller 430 may be configured as one inverter module IM, as shown in FIG. 4 or 5.

The main controller 210 may control the switching operation of the inverter 420 in a sensorless manner.

To this end, the main controller 210 may receive an output current io detected by the output current detector E and a DC terminal voltage Vdc detected by the DC terminal voltage detector B.

The main controller 210 may calculate a power based on the output current io and the DC terminal voltage Vdc, and output a voltage command value Sn based on the calculated power.

In particular, the main controller 210 may perform power control to stably operate the circulation pump motor 730 and output a voltage command value Sn based on the power control. Accordingly, the inverter controller 430 may output a switching control signal Sic corresponding to the voltage command value Sn based on the power control.

The output current detector E may detect an output current io flowing in the 3-phase circulation pump motor 730.

The output current detector E may be disposed between the 3-phase circulation pump motor 730 and the inverter 420 to detect an output current io flowing in the motor. In FIG. 5, it is illustrated that a current of a-phase is detected, out of the phase currents ia, ib, and is which are output currents io flowing in the circulation pump motor 730.

Meanwhile, unlike what is illustrated in FIG. 5, the output current detector E may be disposed between the DC terminal capacitor C and the inverter 420 and sequentially detect the output current flowing in the motor. In this case, one shunt resistance element Rs may be used, and the phase currents ia, ib, and is flowing in the circulation pump motor 730 may be detected in a time-division manner.

The detected output current io may be input to the inverter controller 430 or the main controller 210 as a discrete signal in the form of a pulse. In FIG. 5, it is illustrated that the detected output current io is input to the main controller 210.

The 3-phase circulation pump motor 730 includes a stator and a rotor. The rotor rotates when the AC voltage having a predetermined frequency for each phase is applied to a coil of the stator for each phase (phase a, b, or c).

Such a circulation pump motor 730 may include a brushless DC (BLDC) motor.

The circulation pump motor 730 may include, for example, a surface-mounted permanent-magnet synchronous motor (SMPMSM), an interior permanent magnet synchronous motor (IPMSM), and a synchronous reluctance motor (SynRM). The SMPMSM and the IPMSM are permanent magnet synchronous motors (PMSM) employing permanent magnets, while the SynRM has no permanent magnet.

Figure 6:
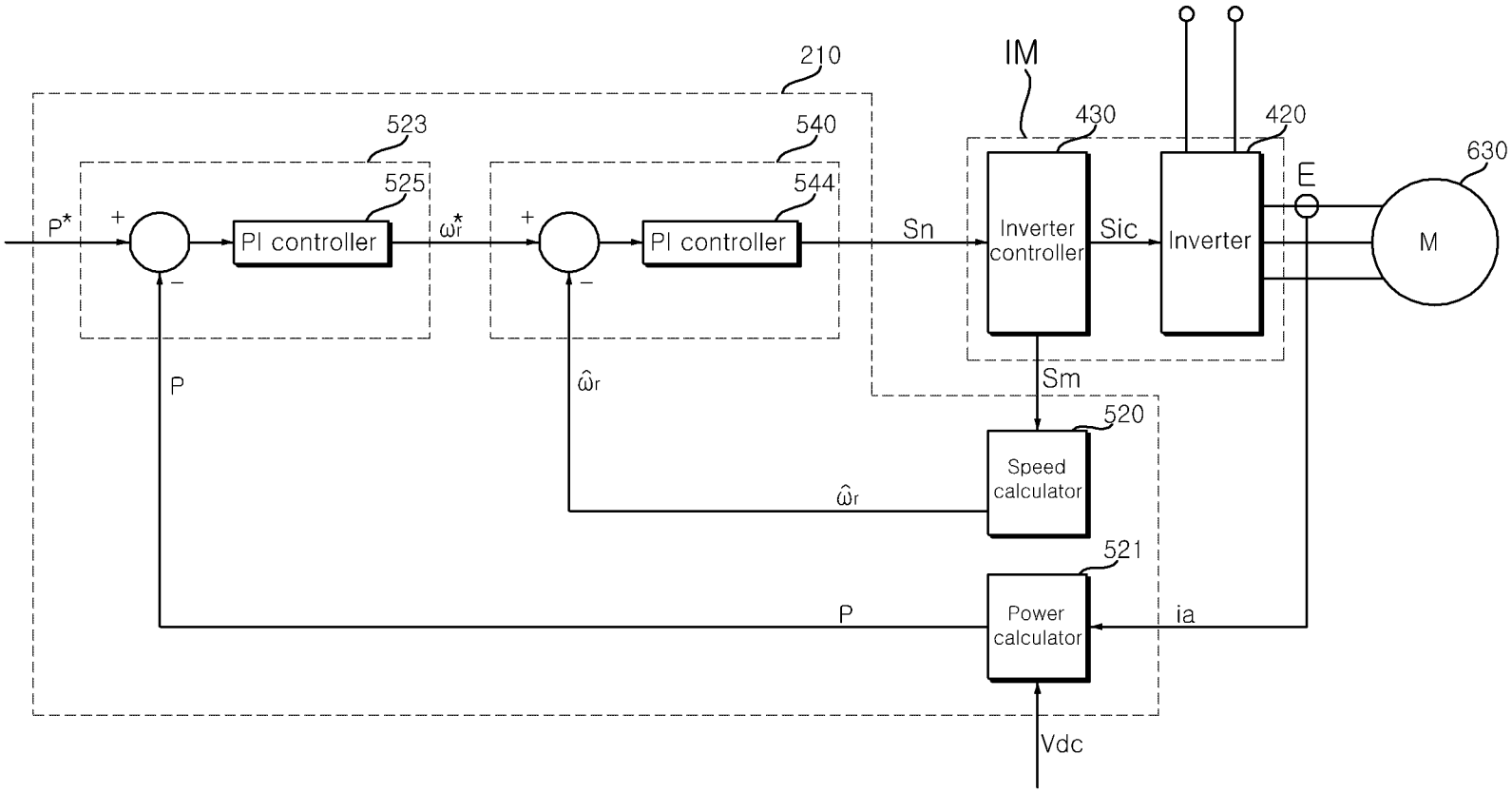
FIG. 6 is an internal block diagram of a main controller of FIG. 5.

FIG. 6 is an internal block diagram of a main controller of FIG. 5.

Referring to FIG. 6, the main controller 210 may include a speed calculator 520, a power calculator 521, a power controller 523, and a speed controller 540.

The speed calculator 520 may calculate a speed of the circulation pump motor 730, based on the voltage information Sm of the circulation pump motor 730 received from the inverter controller 430.

Specifically, the speed calculator 520 may calculate a zero crossing for the voltage information Sm of the circulation pump motor 730 received from the inverter controller 430, and calculate a speed of the circulation pump motor 730 based on the zero crossing.

The power calculator 521 may calculate a power P supplied to the circulation pump motor 730, based on the output current io detected by the output current detector E and the DC terminal voltage Vdc detected by the DC terminal voltage detector B.

The power controller 523 may generate a speed command value w*r based on the power P calculated by the power calculator 521 and a preset power command value P*r.

For example, the power controller 523 may generate the speed command value ω*r, while a PI controller 525 performs PI control, based on a difference between the calculated power P and the power command value P*r.

Meanwhile, the speed controller 540 may generate a voltage command value Sn, based on the speed calculated by the speed calculator 520 and the speed command value ω*r generated by the power controller 523.

Specifically, the speed controller 540 may generate the voltage command value Sn, while a PI controller 544 performs PI control, based on a difference between the calculated speed and the speed command value ω*r.

The generated voltage command value Sn may be output to the inverter controller 430.

The inverter controller 430 may receive the voltage command value Sn from the main controller 210, and generate and output an inverter switching control signal Sic in the PWM scheme.

The output inverter switching control signal Sic may be converted into a gate drive signal in a gate driver (not shown), and the converted gate drive signal may be input to a gate of each switching device in the inverter 420. Thus, each of the switching devices Sa, S'a, Sb, S'b, Sc and S'c in the inverter 420 performs a switching operation. Accordingly, the power control can be performed stably.

Meanwhile, during circulation pumping, the main controller 210 according to an embodiment of the present disclosure may control the power supplied to the circulation pump motor 730 to be constant without decreasing over time. Accordingly, the drainage time may be reduced.

Meanwhile, the main controller 210 according to an embodiment of the present disclosure may control the circulation pump motor 730 such that the power control is performed when the drainage is started and the power control is terminated when a residual water level is reached. Accordingly, drainage operation may be performed efficiently.

The main controller 210 according to an embodiment of the present disclosure may control the voltage command value Sn and a duty of the switching control signal Sic to be greater as the output current io is at a lower level. Accordingly, the circulation pump motor 730 can be driven with a constant power.

The circulation pump motor 730 according to an embodiment of the present disclosure may be implemented as a brushless DC motor 730. Accordingly, the power control, rather than constant speed control, can be implemented in a simple manner.

Meanwhile, the main controller 210 according to an embodiment of the present disclosure may control a speed of the circulation pump motor 730, during circulation pumping, to be increased when a power supplied to the circulation pump motor 730 does not reach a first power and to be decreased when the power supplied to the circulation pump motor 730 exceeds the first power.

Meanwhile, the main controller 210 according to an embodiment of the present disclosure may control the speed of the circulation pump motor 730 to be constant, when the power supplied to the circulation pump motor 730 reaches the first power.

Since the power control is performed such that the circulation pump motor 730 is driven with a constant power, the converter 410 merely needs to supply the constant power. Thus, the stability of the converter can be improved.

Also, the power control makes it possible to minimize a decrease in drainage performance according to installation conditions.

In addition, the circulation pump motor 730 can be driven stably, and furthermore, the drainage time may be reduced.

Figure 7:
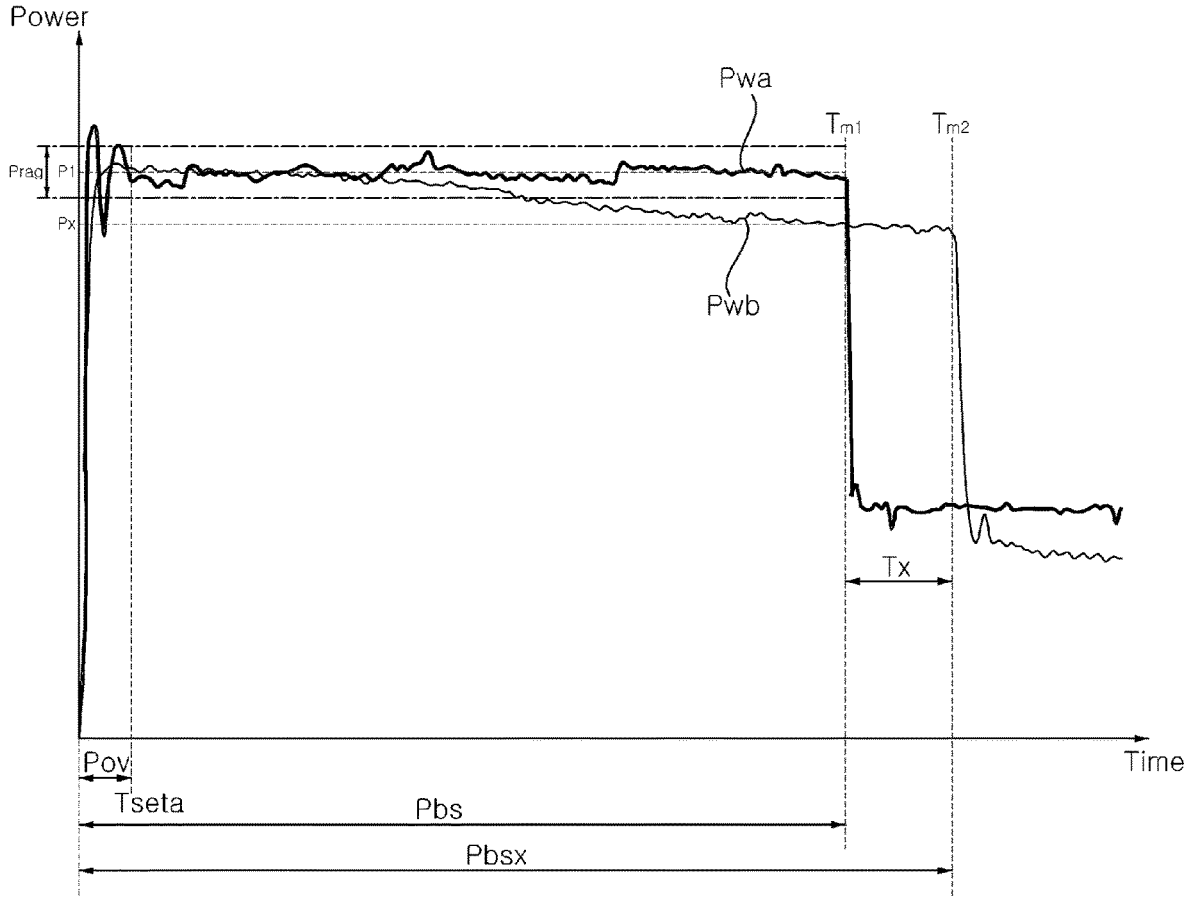
FIG. 7 is a view showing power supplied to a motor according to power control and speed control.

FIG. 7 is a view showing power supplied to a motor according to power control and speed control.

When the power control is performed as in the embodiments of the present disclosure, a time-dependent waveform of the power supplied to the circulation pump motor 730 may be exemplified as Pwa.

FIG. 7 illustrates that the power is maintained to be substantially constant until time point Tm1 by performing the power control, and the power control is terminated at the time point Tm1.

By performing the power control during circulation pumping, the main controller 210 may control the power supplied to the circulation pump motor 730 to be constant without decreasing over time, although a water level in the washing tub 120 decreases.

By performing the power control during circulation pumping, the main controller 210 may control the power supplied to the circulation pump motor 730 to be the first power P1.

In particular, by performing the power control during circulation pumping, even if a lift is changed, the main controller 210 may control the power supplied to the circulation pump motor 730 to be the constant first power P1.

At this time, the constant first power P1 may mean that the circulation pump motor 730 is driven with a power within a first allowable range Prag based on the first power P1. For example, the power within the first allowable range Prag may be a power pulsating within about 10% based on the first power P1.

In FIG. 7, it is illustrated that when the power control is performed, the circulation pump motor 730 is driven with a power within the first allowable range Prag based on the first power P1 from time point Tseta until the time point Tm1 when the drainage is completed, excluding overshooting period Pov. Accordingly, water pumping can be performed smoothly even if the lift is changed during circulation pumping. In addition, the stability of the converter 410 can be improved.

Here, the first allowable range Prag may be greater as the first power P1 is at a higher level. In addition, the first allowable range Prag may be greater as drainage completion period Pbs is longer.

To this end, when the power control is performed during circulation pumping, the main controller 210 may calculate a power based on the output current io and the DC terminal voltage Vdc and output a voltage command value Sn based on the calculated power, and the inverter controller 430 may output a switching control signal Sic to the circulation pump motor 730 based on the voltage command value Sn.

Meanwhile, the main controller 210 may control the voltage command value Sn and a duty of the switching control signal Sic to be greater as the output current io is at a lower level. Accordingly, the circulation pump motor 730 can be driven with a constant power.

Meanwhile, the main controller 210 may control the power supplied to the circulation pump motor 730 to increase abruptly during the period PoV to perform power control.

Meanwhile, the main controller 210 may control the power supplied to the circulation pump motor 730 to decrease abruptly from the time point Tm1 when the power control is terminated.

Unlike the embodiments of the present disclosure, when the speed control is performed, that is, when the speed of the circulation pump motor 730 is controlled to be maintained constantly, a time-dependent waveform of the power supplied to the circulation pump motor 730 may be exemplified as Pwb.

In FIG. 7, it is illustrated that the speed control is performed until time point Tm2, and the speed control is terminated at the time point Tm2.

The waveform Pwb of the power based on the speed control indicates that, during circulation pumping, as the water level in the washing tub decreases, the power supplied to the circulation pump motor 730 may be gradually reduced while the speed of the circulation pump motor 730 is constant.

In FIG. 7, it is illustrated that, during speed control period Pbsx, the power supplied to the circulation pump motor 730 is gradually reduced up to approximately Px at the time point Tm2 when the drainage is completed.

Accordingly, the time point at which the operation of the circulation pump motor 730 is terminated when the speed control is performed is Tm2, which is delayed by approximately period Tx as compared with that when the power control is performed.

Consequently, according to the embodiments of the present disclosure, since the power control is performed during circulation pumping, the drainage time can be shortened by approximately period Tx, as compared with that when the speed control is performed. In addition, the power supplied from the converter 410 can be kept constant, thereby improving the operation stability of the converter 410.

Figure 8:
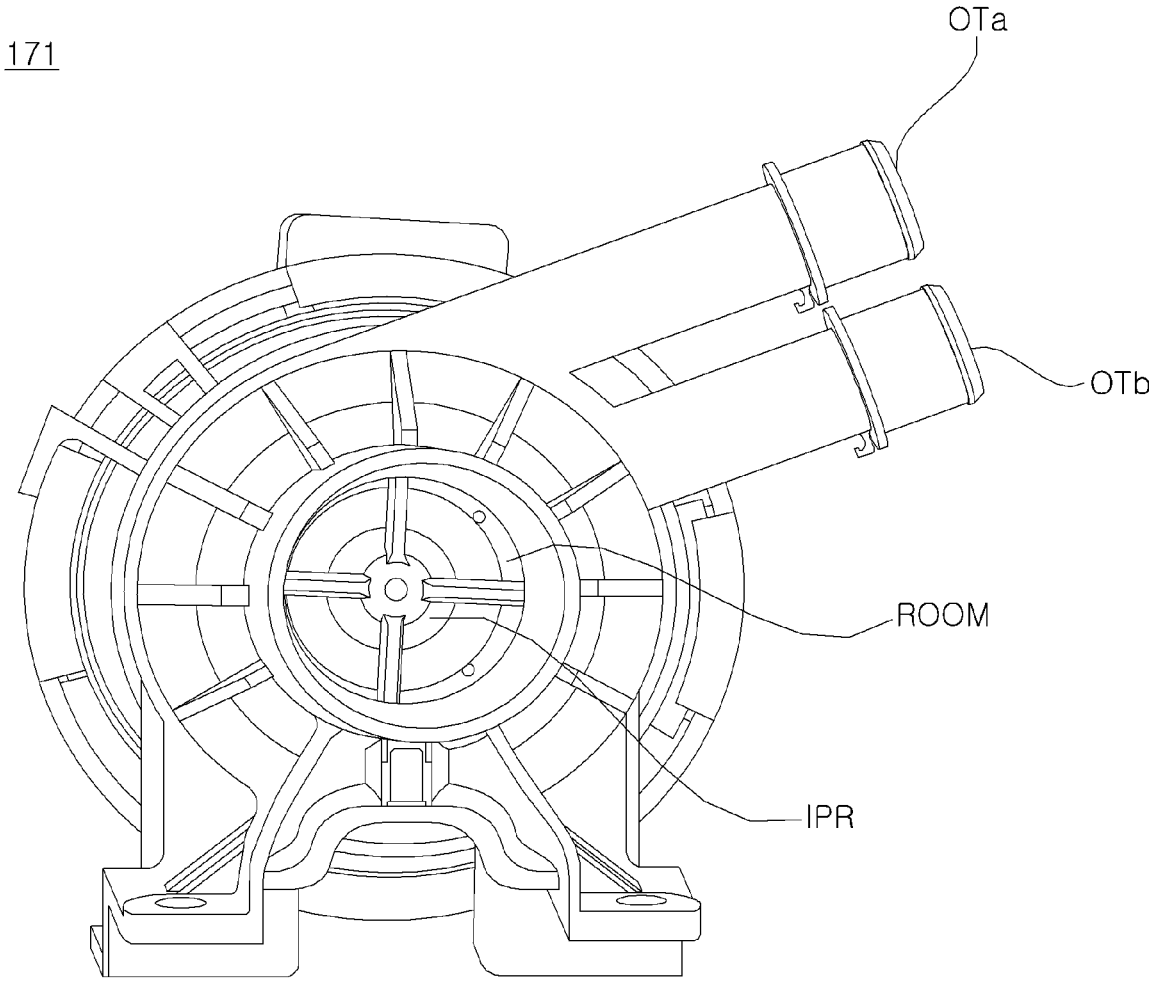
FIGS. 8 and 9 are views illustrating the outer appearance of a circulation pump driving apparatus according to an embodiment of the present disclosure.
Figure 9:
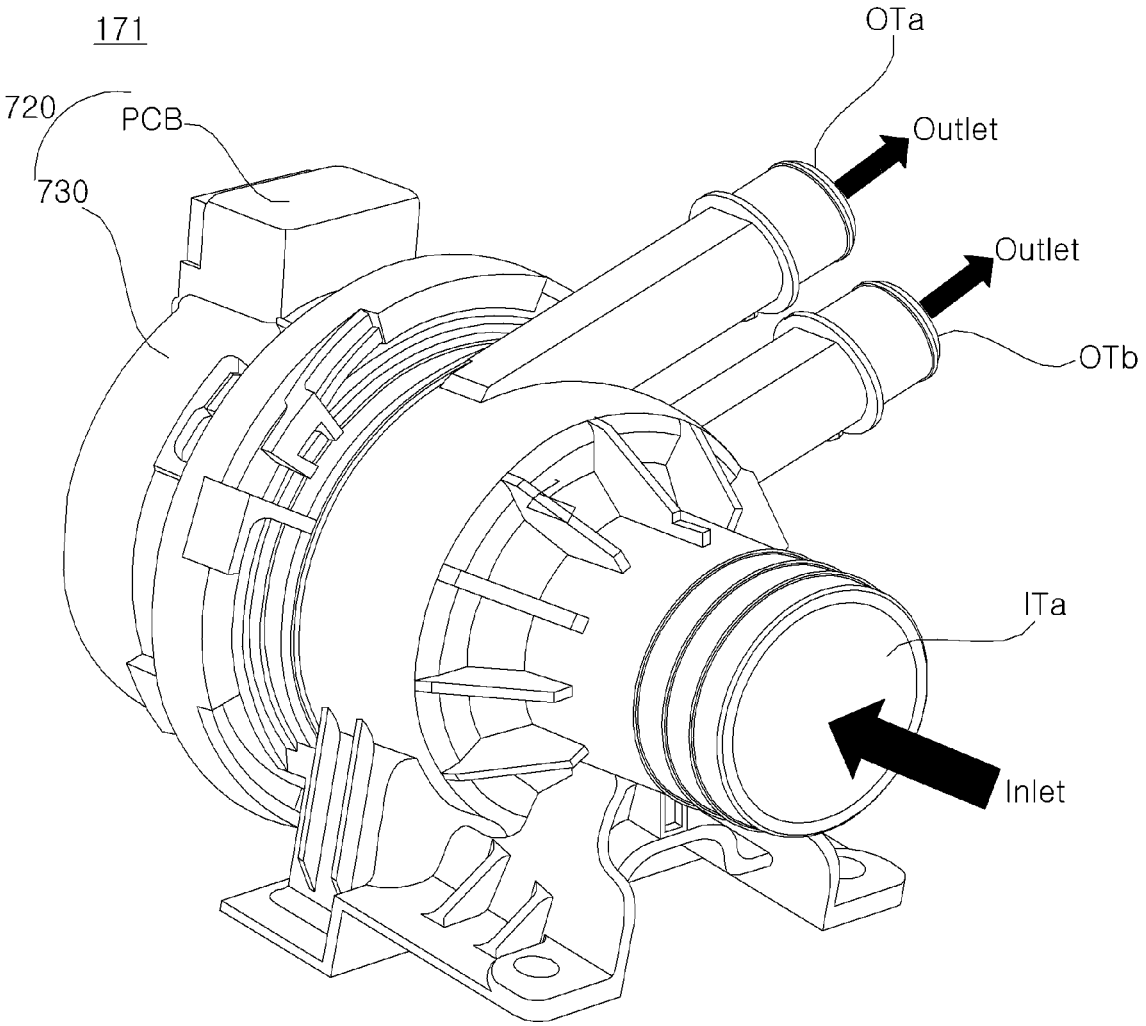

FIGS. 8 and 9 are views illustrating the outer appearance of a circulation pump driving apparatus according to an embodiment of the present disclosure.

Referring to FIGS. 8 and 9, wash water is drained through the drain channel 143 connected to the outer tub 124, and the drain channel 143 is connected to a water introduction part ITa of the circulation pump 171.

The water introduction part ITa is formed of a hollow tube, and a vortex chamber ROOM having a larger diameter than the water introduction part ITa is formed within the water introduction part ITa.

An impeller IPR which rotates by the torque of the circulation pump motor 730 is disposed in the vortex chamber ROOM.

Meanwhile, the circulation pump motor 730 and a circuit board PCB for applying an electrical signal to the circulation pump motor 730 may be disposed on the opposite side of the water introduction part ITa relative to the impeller IPR. The above-described circulation pump driving apparatus 720 may be mounted on the circuit board PCB.

Meanwhile, two water discharge parts OTa and OTb for discharging water may be disposed on one side of the vortex chamber ROOM, in a direction intersecting the water introduction part ITa. In this case, the water discharge parts OTa and OTb may be connected to the circulation channel 144.

Accordingly, the wash water pumped by the circulation pump 171 may be introduced back into the washing tub 120 through the circulation channel 144.

Meanwhile, the water discharge parts OTa and OTb may be formed in a direction normal to the vortex chamber ROOM, for smooth drainage. Such a structure of the circulation pump 171 may be called a volute-type drain pump structure.

In the volute-type drain pump structure, the water discharge parts OTa and OTb are formed on one side of the vortex chamber ROOM. Thus, it is preferable that the circulation pump motor 730 rotates clockwise CW relative to FIG. 9.

Meanwhile, as described above, since the drain pipe 199 is positioned higher than the circulation pump 171, the water discharge parts OTa and OTb may be formed to slope in a direction toward the drain pipe 199.

Similarly, the water introduction part ITa may also be formed to slope, and an angle of slope of the water introduction part ITa to the ground may be smaller than that of the water discharge parts OTa and OTb to the ground. Therefore, water is introduced more smoothly into the water introduction part ITa, and the water in the vortex chamber ROOM is discharged to the outside through the water discharge parts OTa and OTb by means of the impeller IPR which rotates by the torque of the circulation pump motor 730.

Figure 10:
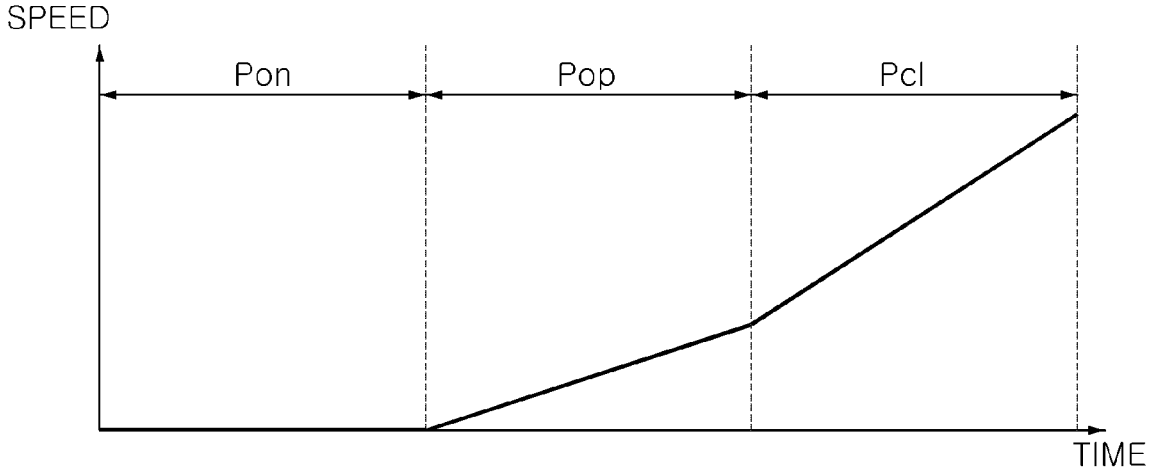
FIG. 10 is a view referred to for explaining the operation of a circulation pump motor.

FIG. 10 is a view referred to for explaining the operation of the circulation pump motor.

Referring to FIG. 10, the operation of the circulation pump motor 730 may be divided into an alignment period Pon, an open loop control period Pop, and a closed loop control period Pcl.

During the alignment period Pon, the main controller 210 may apply a predetermined current to the circulation pump motor 730 to control the rotor of the circulation pump motor 730 to be aligned at a predetermined position. Here, the predetermined current may be a magnetic flux current.

Accordingly, during the alignment period Pon, the rotational speed of the circulation pump motor 730 is 0, as shown in FIG. 10.

Next, after the alignment period Pon, the main controller 210 may control the circulation pump motor 730 to operate in the open loop control period Pop, while the rotational speed of the circulation pump motor 730 continuously increases.

During the open loop control period Pop, the speed command value ω*r as in FIG. 6, continuously increases, and the circulation pump motor 730 is driven based only on the speed command value ω*r without feedback on the output current io detected by the output current detector E.

Next, after the open loop control period Pop, the main controller 210 may control the circulation pump motor 730 to operate in the closed loop control period Pcl, while the rotational speed of the circulation pump motor 730 continuously increases.

During the closed loop control period Pcl, the speed command value ω*r as in FIG. 6, continuously increases or is changed, and the main controller 210 may drive the circulation pump motor 730, with feedback on the output current io detected by the output current detector E, based on a difference between the speed command value ω*r and the output current io.

Figure 11:
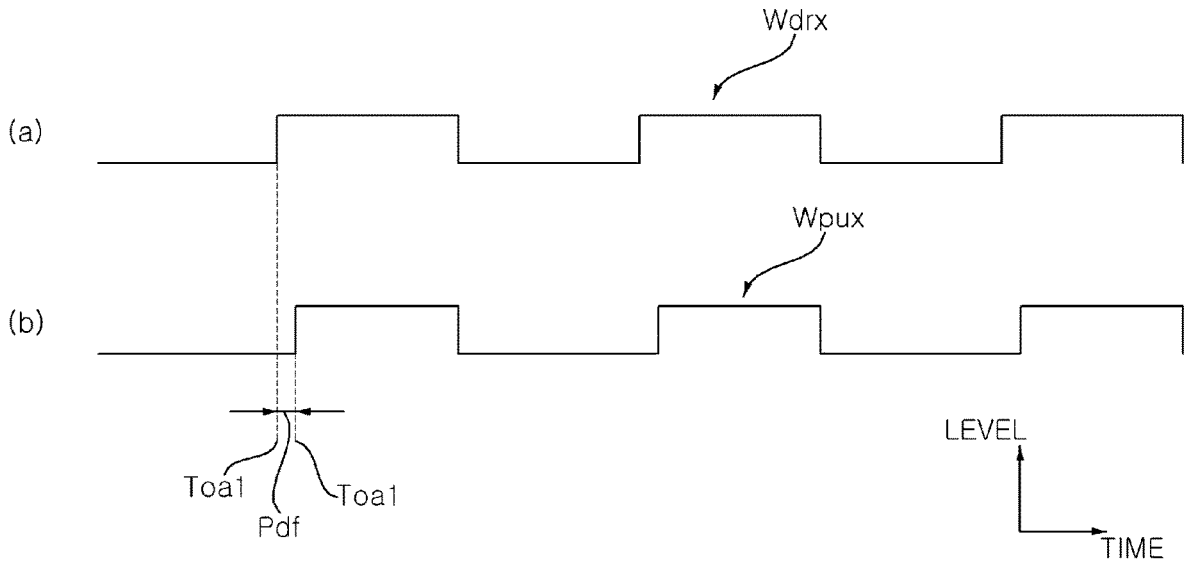
FIG. 11 is a view referred to for explaining the operation of a washing tub motor and a circulation pump motor.

FIG. 11 is a view referred to for explaining the operation of a washing tub motor and a circulation pump motor.

Referring to FIG. 11, (a) of FIG. 11. shows an operation waveform Wdrx of the washing tub motor 230, and (b) of FIG. 11 shows an operation waveform Wpux of the circulation pump motor 730.

In FIG. 11, time point Toa1 is exemplified as a time at which the washing tub motor 230 is turned on and operates.

Meanwhile, an alignment period of the washing tub motor 230, during which a rotor thereof is aligned, may be omitted or shorter than the alignment period Pon of the circulation pump motor 730.

Accordingly, at the time point Toa1, even though the washing tub motor 230 is turned on, the circulation pump motor 730 does not operate immediately after being turned on.

In FIG. 11, it is illustrated that the circulation pump motor 730 operates after being turned on at time point Toa1 that is delayed for period Pdf.

That is, the washing tub motor 230 begins to rotate at the time point Toa1, but the circulation pump motor 730 begins to rotate at the time point Toa1 after the period Pdf elapses. In this way, due to the delay for the period Pdf, the spraying of the wash water circulated by pumping of the circulation pump 171 is delayed, resulting in a decrease in washing power.

In order to solve this problem, the present disclosure proposes a method of synchronizing the washing tub motor 230 and the circulation pump motor 730 with each other. This will be described with reference to FIG. 12 and the subsequent drawings.

Figure 12:
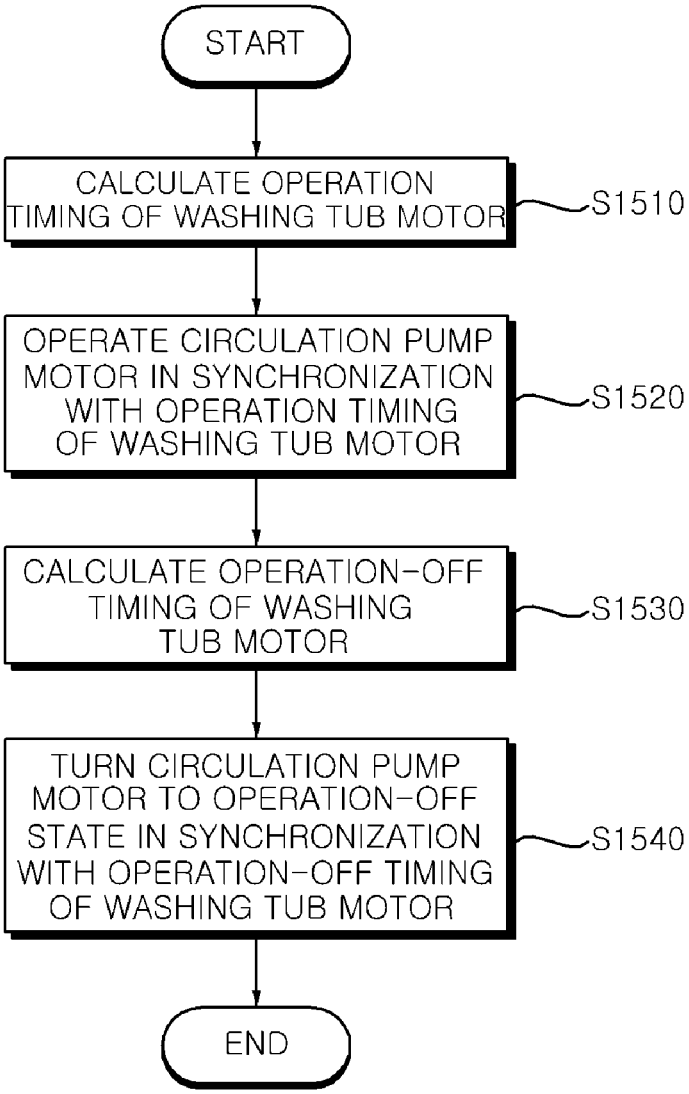
FIG. 12 is a flowchart illustrating an operation method of a laundry treatment machine according to an embodiment of the present disclosure.

FIG. 12 is a flowchart illustrating an operation method of a laundry treatment machine according to an embodiment of the present disclosure, and FIGS. 13 to 15B are views referred to for explaining the operation method of FIG. 12.

Referring first to FIG. 12, the main controller 210 calculates an operation timing of the washing tub motor 230 (S1510).

For example, in a washing, rinsing, or dewatering process, when it is required to not only rotate the washing tub motor but also spray wash water based on circulation pumping, the main controller 210 may calculate an operation timing of the washing tub motor 230.

Next, the main controller 210 may control the circulation pump motor 730 to operate in synchronization with the operation timing of the washing tub motor 230 (S1520).

Figure 13:
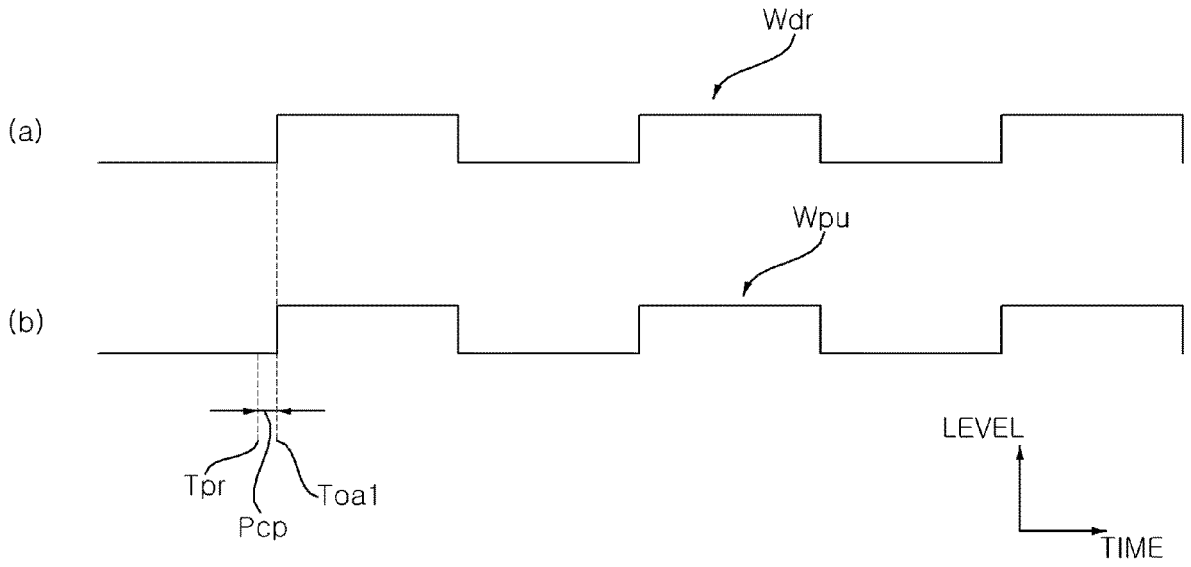
FIGS. 13 to 15B are views referred to for explaining the operation method of FIG. 12.

Referring to FIG. 13, (a) of FIG. 13 shows an operation waveform Wdr of the washing tub motor 230, and (b) of FIG. 13 shows an operation waveform Wpu of the circulation pump motor 730.

In FIG. 13, time point Toa1 is exemplified as a time at which the washing tub motor 230 is turned on and operates.

Meanwhile, an alignment period of the washing tub motor 230, during which a rotor thereof is aligned, may be omitted or shorter than the alignment period Pon of the circulation pump motor 730.

Accordingly, at the time point Toa1, even though the washing tub motor 230 is turned on, the circulation pump motor 730 does not operate immediately after being turned on.

In the present disclosure, in order to solve this problem, the main controller 210 may control the circulation pump motor 730 to be driven in advance before the time point Toa1 in consideration of the motor alignment period of the circulation pump motor 730.

In particular, as shown in FIG. 13, the main controller 210 may control the circulation pump motor 730 to be driven and operated in the motor alignment period at time point Tpr and to be operated in the motor speed increase period at the time point Toa1 when the motor alignment period ends.

Accordingly, the washing tub motor 230 and the circulation pump motor 730 can be operated in synchronization with each other. As a result, it is possible to improve washing power based on circulation pumping during washing.

Next, the main controller 210 calculates an operation-off timing of the washing tub motor 230 (S1530).

For example, in a washing, rinsing, or dewatering process, when it is required to terminate not only the rotation of the washing tub motor but also the spraying of the wash water based on the circulation pumping, the main controller 210 may calculate an operation-off timing of the washing tub motor 230.

Next, the main controller 210 may control the circulation pump motor 730 to be turned to an operation-off state in synchronization with the operation-off timing of the washing tub motor 230 (S1540).

When the washing tub motor 230 is turned to the operation-off state, a speed of the washing tub motor 230 may gradually decrease. Thus, the main controller 210 may control a decreasing speed of the circulation pump motor 730 to be synchronized in response to the decreasing speed of the washing tub motor 230, such that the circulation pump motor 730 and the washing tub motor 230 are turned off at the same time. Accordingly, it is possible to eliminate a period where the circulation pump motor 730 operates alone. As a result, it is possible to reduce unnecessary power consumption of the circulation pump motor 730.

Meanwhile, in the laundry treatment machine according to an embodiment of the present disclosure, the main controller 210 may calculate a length of the alignment period Pcp of the circulation pump motor 730, and control the circulation pump motor 730 to be aligned at the time point Tpr of FIG. 13 in advance prior to the operation timing of the washing tub motor 230, according to the calculated length of the alignment period Pcp. Accordingly, the washing tub motor 230 and the circulation pump motor 730 can be operated in synchronization with each other. As a result, it is possible to improve washing power based on circulation pumping during washing.

Meanwhile, in the laundry treatment machine according to an embodiment of the present disclosure, the main controller 210 may calculate a length of the alignment period Pcp of the circulation pump motor 730, and control the washing tub motor 230 to delay the operation timing thereof according to the calculated length of the alignment period Pcp. Accordingly, the washing tub motor 230 and the circulation pump motor 730 can be operated in synchronization with each other. As a result, it is possible to improve washing power based on circulation pumping during washing.

Figure 14A:
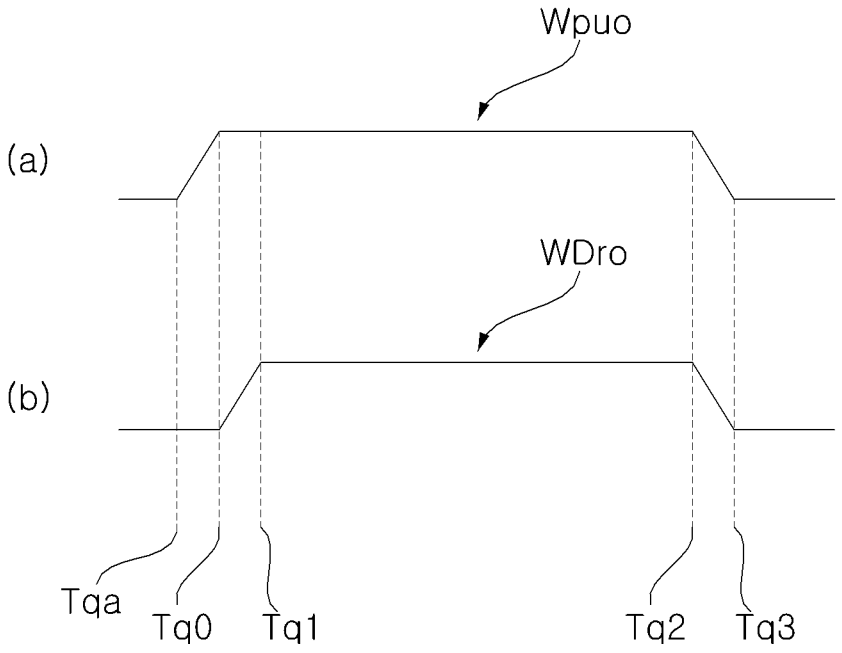

Meanwhile, (a) of FIG. 14A shows an operation waveform Wpuo of the circulation pump motor 730, and (b) of FIG. 14A shows an operation waveform WDro of the washing tub motor 230.

In the laundry treatment machine according to an embodiment of the present disclosure, as shown in FIG. 14A, the main controller 210 may control a speed of the circulation pump motor 730 to be increased before a time point at which the speed of the washing tub motor 230 increases.

Referring to FIG. 14A, the speed of the circulation pump motor 730 may be increased between Tqa and Tq0 before the speed increase period (between Tq0 and Tq1) of the washing tub motor 230.

At the time point when the increase in the speed of the washing tub motor 230 is completed, the circulation pump motor 730 operates at a speed that has already been increased. Accordingly, it is possible to improve washing power based on circulation pumping during washing.

On the other hand, in the laundry treatment machine according to an embodiment of the present disclosure, as shown in FIG. 14A, the main controller 210 may control the speed of the circulation pump motor 730 to be decreased at time point Tq2 when the speed of the washing tub motor 230 decreases.

Accordingly, the main controller 210 may control the speed decrease period of the circulation pump motor 730 to be synchronized in response to the speed decrease period (between Tq2 and Tq3) of the washing tub motor 230. Therefore, the circulation pump motor 730 operates only when necessary and is turned off when not necessary, and thereby, the unnecessary power consumption of the circulation pump motor 730 can be reduced.

Meanwhile, the speed of the washing tub motor 230 may be constant between the speed increase period and the speed decrease period of the circulation pump motor 730, as shown in FIG. 14A.

Figure 14B:
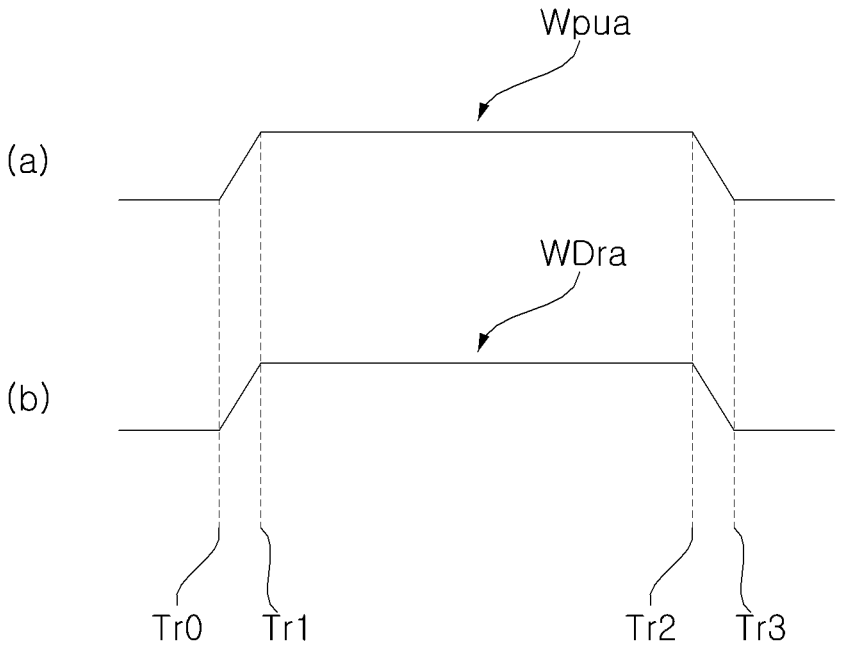

Meanwhile, (a) of FIG. 14B shows an operation waveform Wpua of the circulation pump motor 730, and (b) of FIG. 14B shows an operation waveform WDra of the washing tub motor 230.

In the laundry treatment machine according to an embodiment of the present disclosure, as shown in FIG. 14B, the main controller 210 may control the speed increase period (between Tr0 and Tr1) of the circulation pump motor 730 to be synchronized in response to the speed increase period (between Tr0 and Tr1) of the washing tub motor 230. Accordingly, the washing tub motor 230 and the circulation pump motor 730 can be operated in synchronization with each other. As a result, it is possible to improve washing power based on circulation pumping during washing.

On the other hand, in the laundry treatment machine according to an embodiment of the present disclosure, as shown in FIG. 14B, the main controller 210 may control the speed decrease period of the circulation pump motor 730 to be synchronized in response to the speed decrease period (between Tr2 and Tr3) of the washing tub motor 230. Accordingly, the unnecessary power consumption of the circulation pump motor 730 can be reduced.

Meanwhile, the speed of the washing tub motor 230 may be constant between the speed increase period and the speed decrease period of the circulation pump motor 730, as shown in FIG. 14B.

Figure 14C:
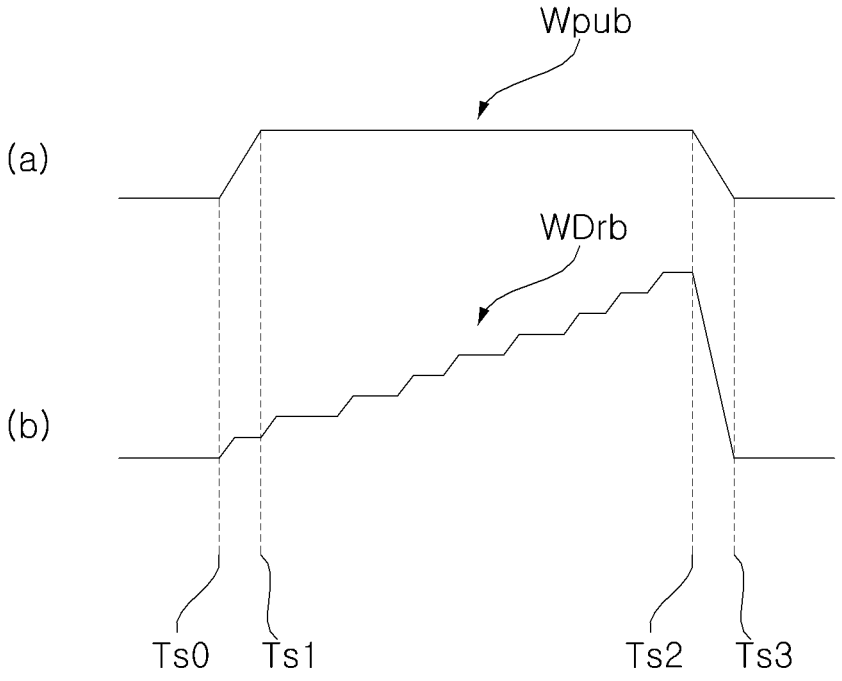

Meanwhile, (a) of FIG. 14C shows an operation waveform Wpub of the circulation pump motor 730, and (b) of FIG. 14C shows an operation waveform WDrb of the washing tub motor 230.

Referring to FIG. 14C, the main controller 210 may control the speed increase period (between Ts0 and Ts1) of the circulation pump motor 730 to be synchronized in response to the speed increase period (between Ts0 and Ts1) of the washing tub motor 230.

On the other hand, referring to FIG. 14C, the main controller 210 may control the speed decrease period of the circulation pump motor 730 to be synchronized in response to the speed decrease period (between Ts2 and Ts3) of the washing tub motor 230. Accordingly, the unnecessary power consumption of the circulation pump motor 730 can be reduced.

Meanwhile, as shown in FIG. 14C, the speed of the washing tub motor 230 may increase step by step between the speed increase period and the speed decrease period of the circulation pump motor 730. The increase in the speed of the washing tub 120 may further improve washing power.

Figure 14D:
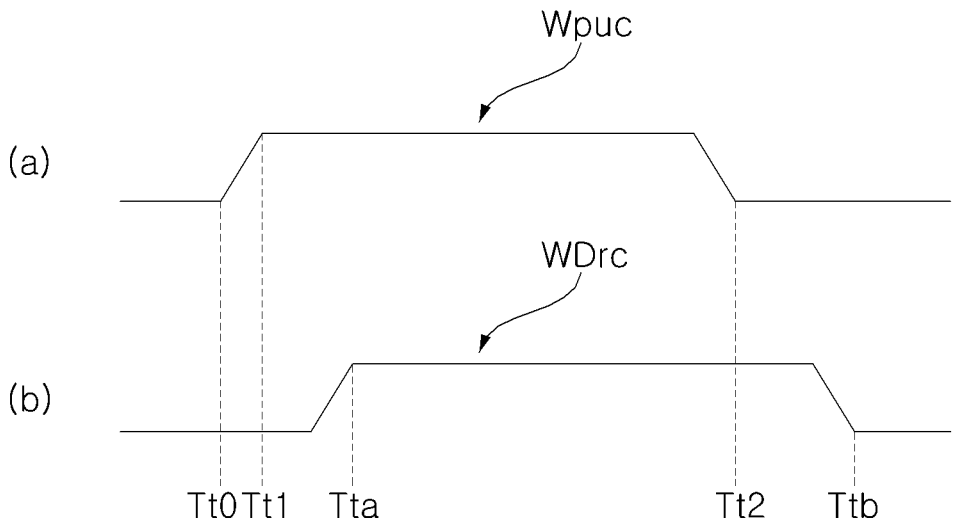

Meanwhile, (a) of FIG. 14D shows an operation waveform Wpuc of the circulation pump motor 730, and (b) of FIG. 14D shows an operation waveform WDrc of the washing tub motor 230.

FIG. 14D illustrates that the circulation pump motor 730 and the washing tub motor 230 are not synchronized with each other, and accordingly, the speed increase period of the circulation pump motor 730 and the speed increase period of the washing tub motor 230 do not match each other, and the speed decrease period of the circulation pump motor 730 and the speed decrease period of the washing tub motor 230 do not match each other.

Figure 15A:
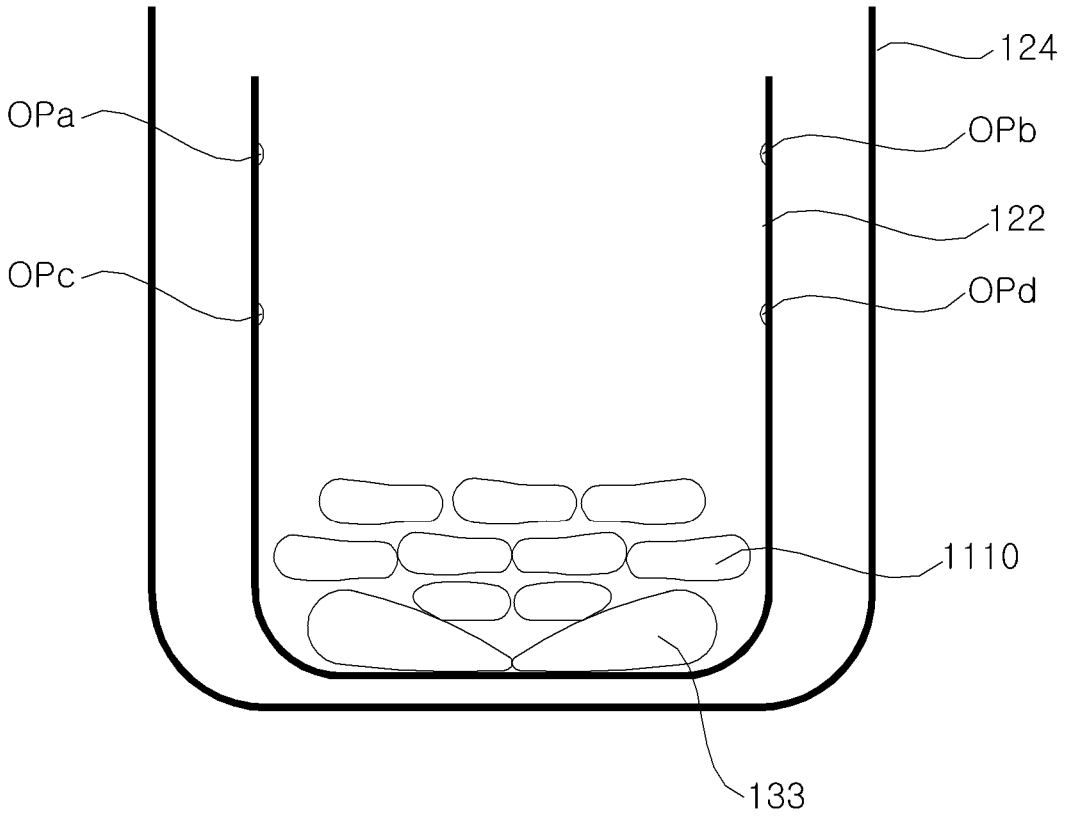

FIG. 15A illustrates that in a state where the washing tub motor 230 is stopped, the circulation pump motor 730 is also stopped, and the wash water is not sprayed through spraying ports OPa to OPd formed in the washing tub 120.

Figure 15B:
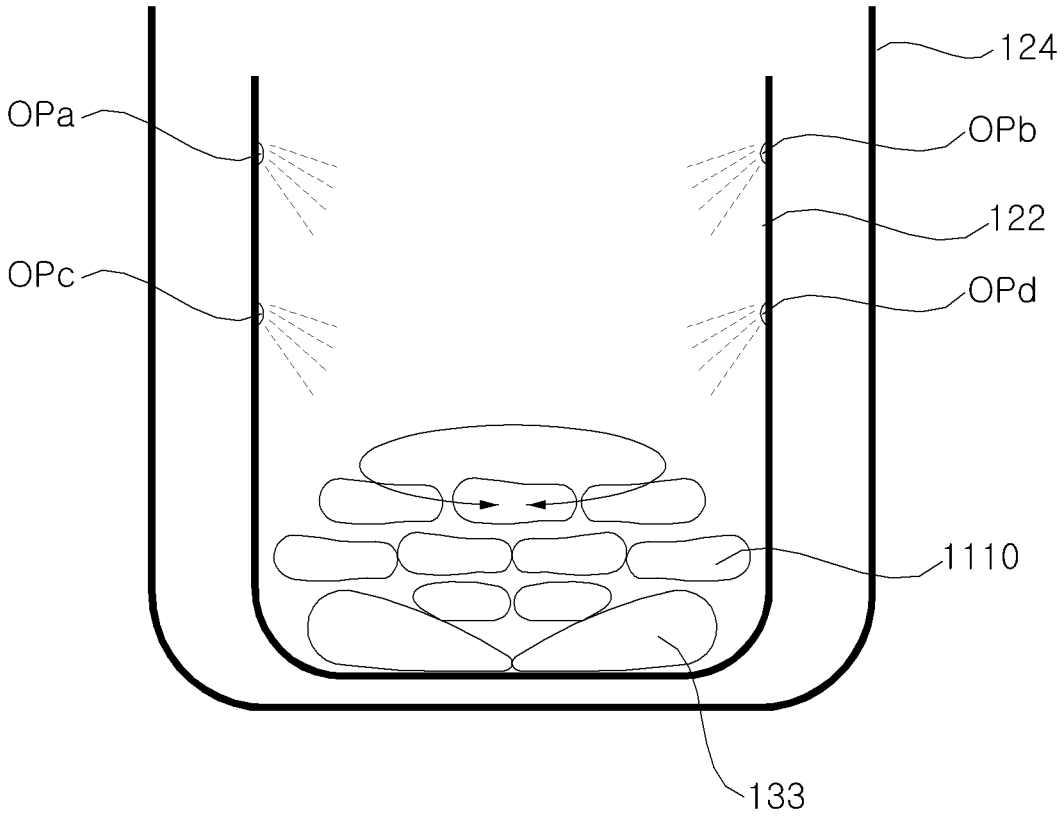

Next, FIG. 15B illustrates that the washing tub motor 230 rotates and the circulation pump motor 730 also rotates in synchronization therewith, such that the wash water circulated by pumping of the circulation pump 171 is sprayed into the washing tub 120 through the spraying ports OPa to OPd formed in the washing tub 120.

To this end, the main controller 210 may control the circulation pump motor 730 such that the wash water circulated by pumping of the circulation pump 171 is sprayed into the washing tub 120 through the spraying ports OPa to OPd formed in the washing tub 120 in synchronization with the operation timing of the washing tub motor 230.

Accordingly, the washing tub motor 230 and the circulation pump motor 730 can be operated in synchronization with each other. As a result, it is possible to improve washing power based on circulation pumping during washing.

Meanwhile, FIG. 1 illustrates a top loading type machine as a laundry treatment machine, but the circulation pump driving apparatus 720 according to an embodiment of the present disclosure may also be applied to a front loading type machine, that is, a drum type machine.

Meanwhile, the circulation pump driving apparatus 720 according to an embodiment of the present disclosure may be applied to various machines such as dishwashers and air conditioners, in addition to the laundry treatment machine 100.

The circulation pump driving apparatus and the laundry treatment machine including the same according to embodiments of the present disclosure are not limited to the configurations and methods of the above-described embodiments, and various modifications to the embodiments may be made by selectively combining all or some of the embodiments.

Meanwhile, a method for operating the circulation pump driving apparatus and the laundry treatment machine according to the present disclosure can be implemented with processor-readable codes in a processor-readable recording medium provided for each of the circulation pump driving apparatus and the laundry treatment machine. The processor-readable recording medium includes all kinds of recording devices for storing data that is readable by a processor.

It will be apparent that, although the preferred embodiments of the present disclosure have been illustrated and described above, the present disclosure is not limited to the above-described specific embodiments, and various modifications can be made by those skilled in the art without departing from the gist of the present disclosure as claimed in the appended claims. The modifications should not be understood separately from the technical spirit or prospect of the present disclosure.

What is claimed is:

1. A laundry treatment machine comprising:
a washing tub;
a washing tub motor to rotate the washing tub;
a circulation pump to circulate wash water introduced from the washing tub by pumping;
a circulation pump motor to operate the circulation pump;
a converter to output a direct current (DC) voltage;
an inverter to convert the DC voltage from the converter into an alternating current (AC) voltage based on a switching operation and to output the converted AC voltage to the circulation pump motor; and
a controller to control a speed of the circulation pump motor to be gradually increased before a time point at which a speed of the washing tub motor increases,
wherein the speed of the circulation pump motor is changed before the time point at which the speed of the washing tub motor increases,
wherein the controller is configured to:
perform power control to the circulation pump motor during circulation pumping, and
in response to a determination that a water level in the washing tub decreases, control a supply of power to the circulation pump motor such that the supplied power to the circulation pump motor is within a first allowable range based on a first power.

2. The laundry treatment machine of claim 1, wherein the controller controls the speed of the circulation pump motor to be decreased at a time point when the speed of the washing tub motor decreases.

3. The laundry treatment machine of claim 2, wherein the controller controls the speed of the washing tub motor to be constant between a speed increase period and a speed decrease period of the circulation pump motor.

4. The laundry treatment machine of claim 2, wherein the controller controls the speed of the washing tub motor to be increased step by step between a speed increase period and a speed decrease period of the circulation pump motor.

5. The laundry treatment machine of claim 1, wherein the controller controls the circulation pump motor to spray the wash water circulated by pumping of the circulation pump into the washing tub through spraying ports formed in the washing tub in synchronization with an operation timing of the washing tub motor.

6. A laundry treatment machine comprising:
a washing tub;
a washing tub motor to rotate the washing tub;
a circulation pump to circulate wash water introduced from the washing tub by pumping;
a circulation pump motor to operate the circulation pump;
a converter to output a direct current (DC) voltage;
an inverter to convert the DC voltage from the converter into an alternating current (AC) voltage based on a switching operation and to output the converted AC voltage to the circulation pump motor; and
a controller to control a speed increase period of the circulation pump motor to be synchronized in response to a speed increase period of the washing tub motor,
wherein the controller controls a speed of the circulation pump motor to be gradually increased in response to the speed increase period of the washing tub motor,
wherein the controller is configured to:
perform power control to the circulation pump motor during circulation pumping, and
in response to determining that a water level in the washing tub is decreasing, control supply of a power to the circulation pump motor such that the power supplied to the circulation pump motor is within a first allowable range based on a first power.

7. The laundry treatment machine of claim 6, wherein the controller controls a speed decrease period of the circulation pump motor to be synchronized in response to a speed decrease period of the washing tub motor.

8. The laundry treatment machine of claim 7, wherein the controller controls a speed of the washing tub motor to be constant between the speed increase period and the speed decrease period of the circulation pump motor.

9. The laundry treatment machine of claim 7, wherein the controller controls a speed of the washing tub motor to be increased step by step between the speed increase period and the speed decrease period of the circulation pump motor.

10. The laundry treatment machine of claim 6, wherein the controller controls the circulation pump motor to spray the wash water circulated by pumping of the circulation pump into the washing tub through spraying ports formed in the washing tub in synchronization with an operation timing of the washing tub motor.

11. The laundry treatment machine of claim 1, wherein the controller controls the circulation pump motor to be maintained at a constant speed after the speed of the circulation pump motor is increased, and when a water level in the washing tub decreases in state in which the circulation pump motor is maintained at the constant speed, the controller is configured to sustain the power supplied to the circulation pump motor to be within the first allowable range of the first power.

12. The laundry treatment machine of claim 1, wherein, when the power supplied to the circulation pump motor reaches the first power, the controller controls the speed of the circulation pump motor to be constant.

13. The laundry treatment machine of claim 1, wherein, when the power supplied to the circulation pump motor does not reach the first power, the controller controls the speed of the circulation pump motor to be increased, and when the power supplied to the circulation pump motor exceeds the first power, the controller controls the speed of the circulation pump motor to be decreased.

14. The laundry treatment machine of claim 6, wherein the controller controls the circulation pump motor to be maintained at a constant speed after the speed of the circulation pump motor is increased, and when a water level in the washing tub decreases in state in which the circulation pump motor is maintained at the constant speed, the controller is configured to sustain the power supplied to the circulation pump motor to be within the first allowable range of the first power.

15. The laundry treatment machine of claim 6, wherein, when the power supplied to the circulation pump motor reaches the first power, the controller controls the speed of the circulation pump motor to be constant.

16. The laundry treatment machine of claim 6, wherein, when the power supplied to the circulation pump motor does not reach the first power, the controller controls the speed of the circulation pump motor to be increased, and when the power supplied to the circulation pump motor exceeds the first power, the controller controls the speed of the circulation pump motor to be decreased.

17. A circulation pump driving apparatus comprising:

a circulation pump to circulate wash water introduced from an inner tub by pumping;

a circulation pump motor to operate the circulation pump;

a converter to output a direct current (DC) voltage;

an inverter to convert the DC voltage from the converter into an alternating current (AC) voltage based on a switching operation and to output the converted AC voltage to the circulation pump motor; and a controller to control a speed of the circulation pump motor to be gradually increased before a time point at which a speed of an inner tub motor increases, wherein the speed of the circulation pump motor is changed before the time point at which the speed of the inner tub motor increases, wherein the controller is configured to:

perform power control of the circulation pump motor during circulation pumping, and in response to determining that a water level in the inner tub decreasing, control a supply of power to the circulation pump motor to be within a first allowable range based on a first power.

18. The circulation pump driving apparatus of claim 17, wherein the controller controls the circulation pump motor to be maintained at a constant speed after the speed of the circulation pump motor is increased, and when the circulation pump motor is maintained at the constant speed, if a water level in the inner tub decreases, the controller controls the circulation pump motor to be supplied with a constant power.

19. The circulation pump driving apparatus of claim 17, wherein the controller controls the speed of the inner tub motor to be increased step by step between a speed increase period and a speed decrease period of the circulation pump motor.

* * * * *